United States Patent [19]

Shrontz et al.

[11] 4,174,803

[45] Nov. 20, 1979

[54] MULTICELL CORRUGATED BULK CONTAINER

[75] Inventors: Michael J. Shrontz, Ingalls; Robert M. Harvey, New Palestine, both of Ind.

[73] Assignee: Inland Container Corporation, Indianapolis, Ind.

[21] Appl. No.: 814,972

[22] Filed: Jul. 12, 1977

[51] Int. Cl.[2] ..... B65D 3/24; B65D 5/56

[52] U.S. Cl. ..... 229/15; 229/37 R; 229/23 R

[58] Field of Search ..... 226/15, 37 R, 14 BL, 226/23 R; 206/386, 600

[56] References Cited

U.S. PATENT DOCUMENTS

| | | | |
|---|---|---|---|
| 2,097,708 | 11/1937 | Trost | 229/14 BL X |
| 2,362,862 | 11/1944 | Sidebottom | 229/37 R |
| 2,926,777 | 3/1960 | Maguire | 229/37 R X |
| 3,248,039 | 4/1966 | Locke | 229/37 R |
| 3,403,835 | 10/1968 | Schwammer | 229/15 |
| 3,425,615 | 2/1969 | Wood | 229/15 |
| 3,543,991 | 12/1970 | George | 229/15 |
| 3,559,867 | 2/1971 | Muskopf | 229/14 BL |
| 3,880,341 | 4/1975 | Bamburg | 229/14 BL X |
| 3,904,105 | 9/1975 | Booth | 229/15 |

*Primary Examiner*—Davis T. Moorhead
*Attorney, Agent, or Firm*—Fitch, Even & Tabin

[57] ABSTRACT

A bulk container for shipping granular products or the like. A pair of rectangular tubular cells having interior manufacturer's joints are surrounded by an outer rectangular sleeve glued in continuous surface-to-surface contact therewith. The sleeve panels carry depending flaps that form a tubular, bellows, bottom closure, and the sleeve contains an exterior manufacturer's joint that extends downward into the closure. One pair of closure flaps each include converging 45° score lines which meet short of its free edge, and a slot extends inward past the point of meeting.

9 Claims, 12 Drawing Figures

Fig. 1.
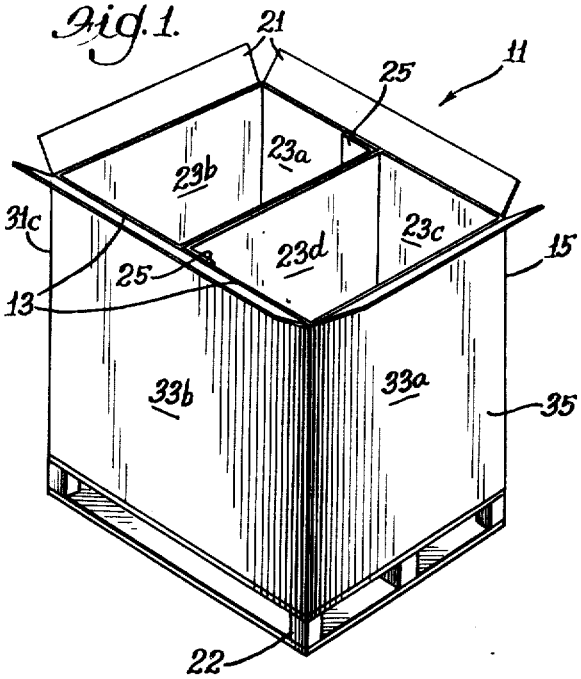
Fig. 2.
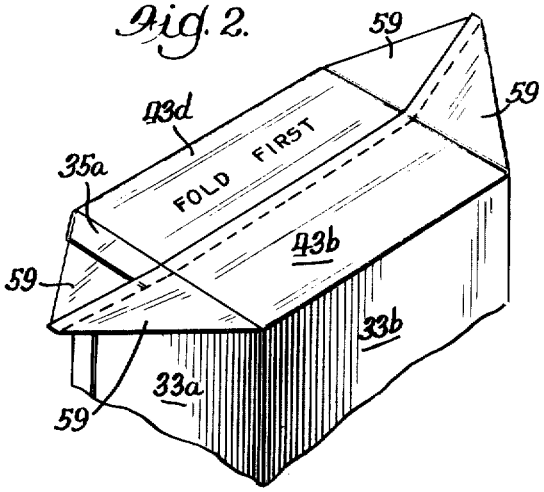
Fig. 3.
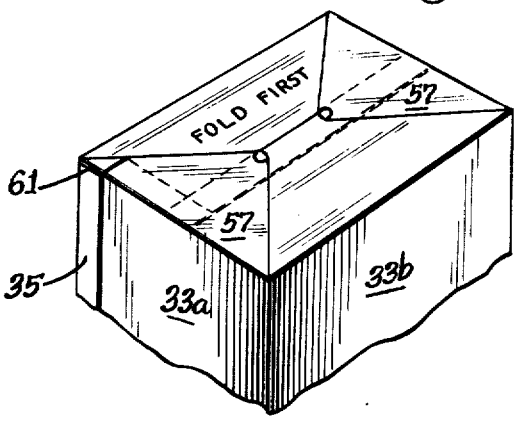
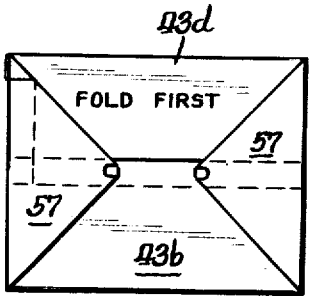
Fig. 4.
Fig. 6.
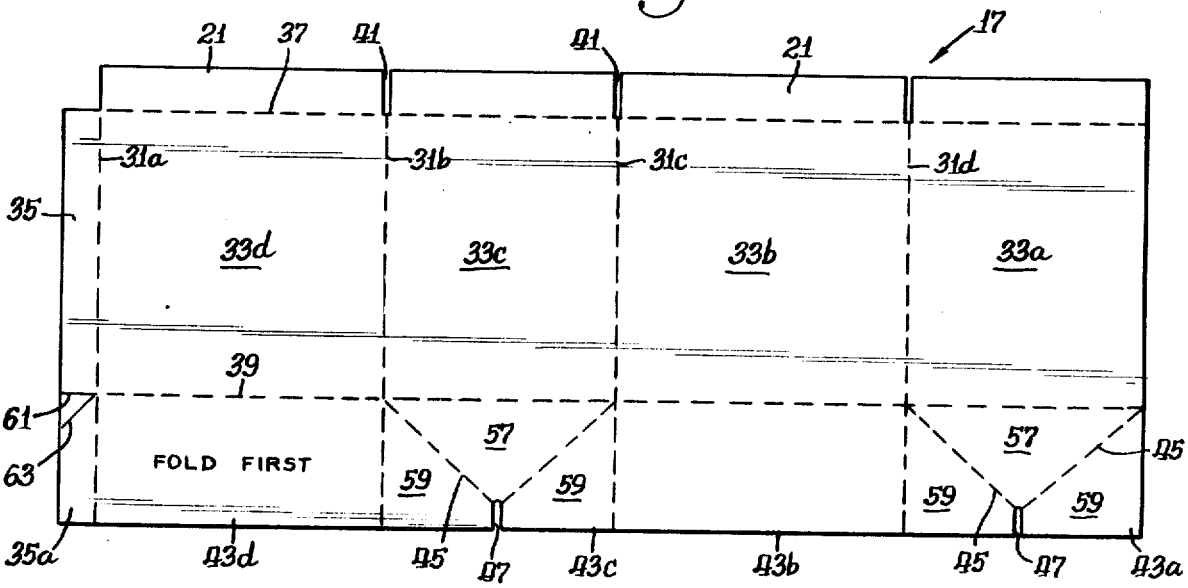

Fig. 5a.
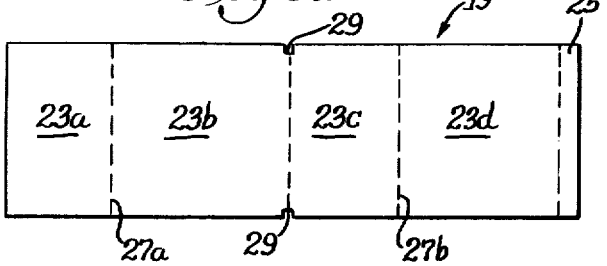
Fig. 5b.
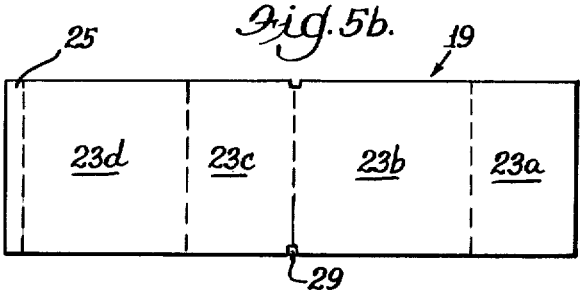
Fig. 5c.
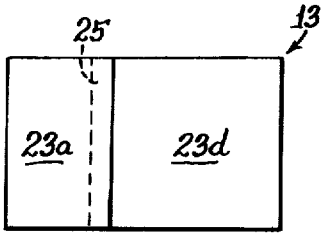
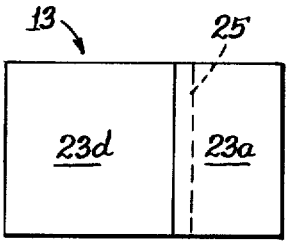
Fig. 5d.
Fig. 5e.
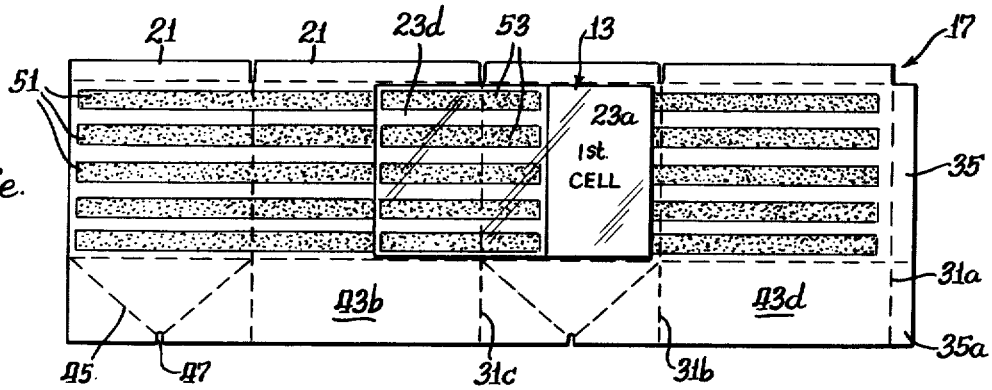
Fig. 5f.
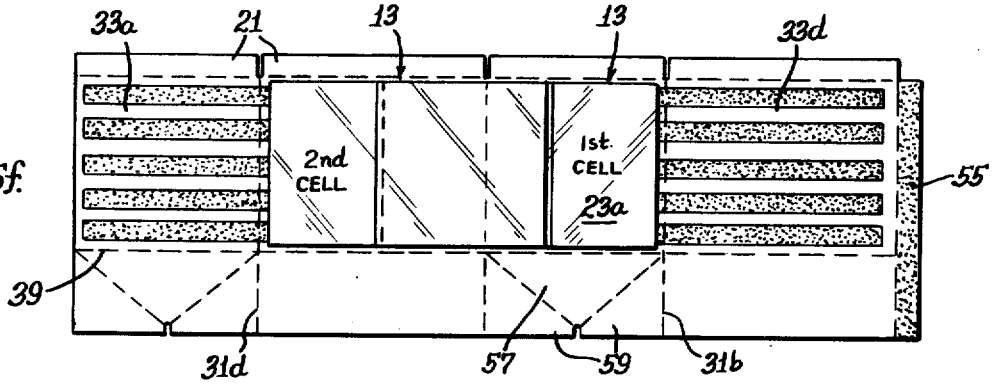
Fig. 5g.
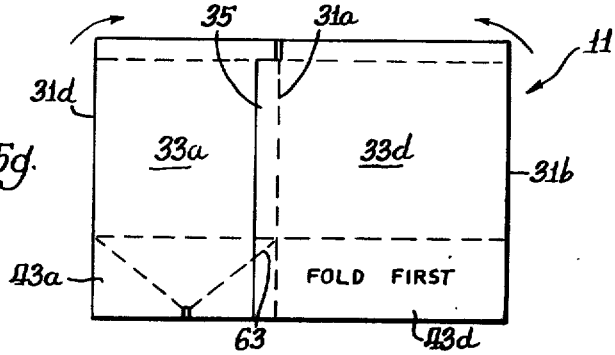

MULTICELL CORRUGATED BULK CONTAINER

The invention relates generally to bulk containers and more particularly to multiple cell containers made of corrugated fiberboard for holding large amounts of granular material.

Various types of multi-cell containers have been developed and are now being used for bulk shipments of flowable materials, particularly materials in granular form. Examples of such bulk containers may be found in U.S. Pat. Nos. 3,403,835, issued Oct. 1, 1968, 3,425,615 issued Feb. 4, 1969, and 3,543,991, issued Dec. 1, 1970.

The present invention provides an improved reusable bulk container made of corrugated fiberboard having excellent strength characteristics which enable it to hold a ton or more of granular material. The container design of laminated construction eliminates gaps within its interior or its sidewalls; thus, it is particularly adapted for shipment of granular food material, for example, shelled peanuts, where cleanliness and the ability to completely empty the container are of substantial importance.

Various features and advantages of the invention will be apparent from the following detailed description of a preferred embodiment of a bulk container, when read in conjunction with the accompanying drawings wherein:

FIG. 1 is a perspective view of a twin-cell bulk container embodying various features of the invention;

FIG. 2 is a view of the bulk container in inverted condition shown as the bellows bottom is being closed during the set-up procedure prior to filling;

FIG. 3 is similar to FIG. 2 and shows the flaps folded to the closed position;

FIG. 4 is a bottom view of the container as shown in FIG. 3;

FIGS. 5*a* through 5*g* are a series of views illustrating the three separate blanks from which the twin-cell bulk container of FIG. 1 is fabricated and showing the gluing and folding procedure which takes place as a part of the fabrication; and FIG. 6 is a view of the outside surface of the blank for the outer box portion of the twin-cell container.

A twin-cell bulk container 11 is depicted in FIG. 1 set-up to a configuration ready to receive the material to be shipped, for example, a ton of shelled peanuts. The container 11 has a pair of inner cells 13 surrounded by an outer sleeve or box 15, is fabricated from three separate corrugated pieces or blanks 17 and 19 and has a self-contained bottom closure of the type generally referred to as a bellows bottom. The container 11 has short flanges 21 at the upper ends of the four sidewalls. These flanges are folded inward at 90° to the sidewalls, and a separate top cap (not shown) of the standard construction slides downward over the upper end of the container and holds the top flanges in this desired position where they add strength to the overall container. Because of its weight when filled, the bulk container 11 is usually used in combination with a pallet 22 of standard design.

A substantial portion of the strength of the container results from the fact that it, in essence, consists of three separate boxes laminated together into a single assembly which includes its own self-contained bottom closure. Basically, the duplicate inner cells 13, which are surrounded by the rectangular outer box 15, divide the container into two equal compartments. A container 11 suitable for shipping a ton of shelled peanuts can be made from one outer box blank 17, which is about 175 inches by 71 inches, and two inner cell blanks 19, which are each about 126 inches by 45 inches. All three blanks are made from corrugated fiberboard wherein the corrugations run vertically in the container 11 so as to provide sufficient stacking strength to enable these containers, when each is filled with a ton of peanuts, to be stacked three high. Suitable blanks may be made from B/C flute doublewell corrugated board (500 pound test); however, other size flutes as well as other corrugated board, for example, triplewall, may also be used.

As best seen in FIGS. 5*a* and 5*b*, the blanks 19 for the inner cells consists simply of four serially connected panels 23*a,b,c,d*, plus a glue flap 25 which are defined by four vertical score lines 27. Although the term "score line" is used throughout the application, it should be understood that use of this term is simply meant to indicate the employment of a suitable line of weakness which may be made in any conventional manner, as by scoring, perforating, slitting, cutting or the like. In addition, a pair of upper and lower nick slots 29 are provided, each about ½ inch deep, which facilitate alignment in the fabrication of the laminated containers 11 as explained hereinafter. The blanks 19 are sized so that the narrower side panels 23*a* and *c* have a width approximately equal to one-half the longitudinal dimension of the rectangular container 11, whereas the wider side panels 23*b* and d are substantially equal to the transverse or lateral dimension of the container.

To fashion the manufacturer's joint in each cell, a line of adhesive is either applied to the underside of the glue flaps 25 as shown in FIG. 5*a*, and 5*b*, or upon the upper surface of the side panel 23*a*, and then folding is carried out along the vertical score lines 27*a* and 27*b* to create the flat-folded tubes depicted in FIGS. 5*c* and 5*d*. Fabrication in this manner adheres the glue flap 25 to the inside surface of the cell wall and thus disposes it within the interior of the cell, so that an undesirable gap is not created between the outside surface of the cell 13 and the inside surface of the surrounding box 15 to which it will be laminated, the importance of which is discussed hereinafter.

The blank 17 for forming the outer box, as illustrated in FIG. 6, includes four vertical score lines 31 which define the four serially connected side panels 33 plus a glue flap 35 at the left-hand edge of the blank. The score lines 31 extend for substantially the full height of the blank and are crossed by upper and lower transverse score lines 37 and 39. The upper transverse score line 37 defines the four top flanges 21 which are preferably separated from one another by slots 41 and which are individually hinged to one of the side panels 33. The lower score line 39 defines four interconnected bottom flaps 43 which are individually hingedly attached to the bottom edge of one of the four side panels 33.

The bottom flaps 43*a* and 43*c* which are hinged to the narrower side panels 33*a* and 33*c*, are herein referred to as the lateral bottom flaps and are appropriately scored and slotted so that, upon completion of the manufacturer's joint, the bottom closure flaps 43 provide an improved bellows bottom closure. The remaining pair of bottom closure flaps 43*b*, and 43*d*, which are hinged to the longitudinal or wider side panels 33*b* and 33*d*, are referred to as the longitudinal bottom flaps and are integrally connected to the lateral closure panels along the vertical score lines 31. Each of the lateral flaps 43*a*, 43*c* is provided with a pair of converging score lines 45 which are oriented at about 45° to the lower transverse score line 39, beginning at the intersections between it and each one of the vertical score lines 31. Moreover, a short slot 47 extends from the free or bottom edge of the lateral flaps 43*a*,43*c* to a location past the intersection of the converging score lines 45. The function of the slots 47 is described hereinafter, together with a description of the closing of the bottom of the container 11.

The container 11 is designed to be efficiently fabricated on suitable laminating equipment. The inside surface of blank 17 for the outer box is positioned appropriately, and an adhesive pattern 51 in the form of a plurality of parallel strips, which cover more than 60 percent of the area of the side panels 33, is applied running from the left-hand edge of the blank continuously across to a location just short of the glue flap 35. The flat-folded blank 19 for the first inner cell is then positioned upon the outer box blank, as shown in FIG. 5*e* with the manufacturer's joint in the upper location. The nick slots 29 facilitate appropriate positioning because they can be aligned by the operator with the vertical score line 31*c*. A similar adhesive strip pattern 53 is then applied over the major portion of the outside surface of the panel 23*d* of the first cell that will be in surface-to-surface contact with the second cell. The second cell is then positioned as depicted in FIG. 5*f* with its manufacturer's joint down and with its wider side panel 23*d* in contact with the corresponding side panel 23*d* on the first cell to which the adhesive pattern 53 has just been applied.

After the application of adhesive 55 to the upper surface of the glue flap 35 at the right-hand edge of the outer box blank, the lateral panel 33*a* at the left-hand edge is first folded over the second cell to contact panel 23*b*, and then the longitudinal side panel 33*d*, carrying the glue flap 35, is folded over and onto it to locate the manufacturer's joint on the outside surface of the container 11. The folded and glued, three-blank assembly is then subjected to compression while the adhesive sets up and effects the fiberboard-to-fiberboard bonding. As a result of the continuous glue patterns provided on the outer box blank 17, there is a tight connection between the outer box 15 and the laminated inner cells 13 at all four corners of the container that not only adds to the overall strength of the container but guards against peanuts from becoming lodged in such corner gaps.

The containers are shipped to the customer in the flat-folded condition depicted in FIG. 5*g*, and because of the improved bellows bottom closure, they can be set up by a single operator, need not be glued and are reusable for additional trips after reaching their destination and being emptied. To ready the container 11 for filling, the operator squares it in the inverted position and then folds the rectangular, longitudinal bottom closure flaps 43*d* and 43*b* inward first, in accordance with the instruction printed on panel 43*d*, see FIG. 6. The inward folding of the longitudinal flaps causes the lateral flaps 43*a*,43*c* to break and fold along the 45° score lines 45 which define major triangular panels 57 flanked by minor triangular panels 59.

The depth of the tubular bottom closure is such that the longitudinal flaps 43*b*,43*d* overlap, preferably by at least about two inches. To avoid having to die-cut the blank 17, the depth of each of the bottom flaps 43 is the same, and each is about one-inch deeper than half the width of the lateral panels 33*a*,33*c* of the outer box blank, to which the flaps 43*a*,43*c* containing the converging score lines 45 are hinged. This overlapping assures a tight joint at the bottom of the container below the twin cells 13 without requiring strict tolerances in dimensions in a large bulk container of this type.

As the folding inward of the longitudinal flaps 43*b*,43*d* is completed, the minor triangular panels 59 are folded to contact with the central major triangular panel 57. The provision of the slot 47 frees the outer corners of the minor panels 59 and allows this folding to take place without restraint. Following the infolding of both longitudinal bottom flaps, the bottom closure is completed by folding in the major triangular panels 57 so that the bottom takes the shape depicted in FIG. 3.

As shown in FIG. 6, the glue flap 35 on the outer box preferably includes a downward extension 35*a* which is a part of the bottom closure. It is also positioned at a corner of the box 15, as are the manufacturer's joints of the inner cells 13 positioned at corners, so as to avoid the creation of any gap between the laminated sidewalls of the outer box and the inner cells which could provide an open region wherein peanuts could accumulate. When the outer box blank 17 is made from a strong thick material, such as doublewall corrugated fiberboard, the thicknesses which are created at the location of the extension 35*a* of the glue flap into the bellows closure can exert a considerable restraint to bending. Bending can be eased by providing a short, horizontal slit 61 in the glue flap in line with the lower transverse score line 39 and furthermore by providing a second slit 63 at an angle where the glue flap extension 35*a* will overlap the score line 45 of the closure panel 43*a* to which it will be laminated. The second angular slit facilitates the 180° bend which occurs when the flanking triangular panels 59 are folded onto the major triangular panel 57 (FIG. 2) and the short horizontal slit 61 facilitates the 90° bend which completes the bottom closure by the infolding of the triangular panels 57 (FIG. 3).

With the container 11 set up as depicted in FIG. 1, it is ready to be filled by loading the inner cells 13 with about 1000 pounds of peanuts apiece. This is generally accomplished by positioning a chute over the cells through which a weighed amount of granular product is allowed to fall by gravity. The container 11 may be vibrated if desired during the loading, which may be performed incrementally, to assure complete filling is accomplished.

The upper flanges 21 are generally outfolded in order to set the container on the floor during the set-up of the bellows bottom, and the flanges 21 may be left in this position during filling. However, once filling is completed, the upper flanges 21 are folded inward so that they overlie the adjacent upper edges of the sidewalls of the inner cells 13 to which the outer box sidewalls have been laminated, and the flanges are retained in this horizontal orientation by the downward application of a top cap. If desired, the flanges may be temporarily taped to each other to hold them in this position until the cap has been installed. Thereafter, one or more metal or plastic straps or bands may be encircled around the capped and filled container as an added guarantee against separation of the cap during shipment and handling. The provision of the upper flaps and their inward folding at 90° to the vertical sidewalls increases the sidewall strength of the box and is particularly effective in resisting bulging.

As earlier indicated, the overall laminated twin-cell construction is particularly suited for shipping a granular food product, such as peanuts, where complete unloading of the container prior to its knockdown and return for reuse is of importance. Its strength which is achieved by the provision, in essence, of two separate boxes which are laminated to each other and within a third box that contains a bellows bottom that unites the overall structure, and such excellent overall strength is achieved to allow these bulk containers to be stacked three levels high. Moreover, the improved bellows bottom not only provides a tight seal that prevents such a granular product from escaping at the bottom, but it also provides a tight fit where the side edges of the longitudinal flaps 43*b*,43*d* abut the inside surface of the lateral side walls 23*b* of the inner cells and thus minimizes the entrapment of peanuts therein. Thus, the bulk container 11 is advantageously suited for repeated shipments of a granular food product not only in quantities of at least a ton at a time, but also in stacked array to facilitate efficient transport by truck or rail.

Although the invention has been described with regard to certain preferred embodiments, it should be understood that various changes and modifications as would be obvious to one having the ordinary skill in this art may be made without deviating from the scope of the invention which is defined solely by the claims appended hereto. For example, instead of providing the flanges 21 at the top of the panels 33 of the blank 17, top flanges could be provided atop the panels 23 of the blanks 19 and would be infolded in similar fashion before the top cap is installed. Various of the features of the invention are set forth in the claims which follow.

What is claimed is:

1. A reusable bulk container for shipping granular products or the like, which container includes a pair of rectangular tubular cells each of which is formed from four serially connected panels of corrugated fiber-board having vertical flutes and having flap means at one end, and an outer rectangular sleeve surrounding said cells and disposed in continuous surface-to-surface contact with the outside surfaces of six panels of said pair of cells, said sleeve including four serially connected rectangular panels joined along three vertical score lines which panels carry depending flaps for closing the bottom of the container defined by a transverse score line, said sleeve inside surface being adhesively joined to said outside surfaces of said six cell panels by an adhesive pattern which covers a major portion of surface area of each of said sleeve panels, wherein the improvement comprises said flap means of each tubular cell being formed as a manufacturer's joint by attachment to the inside surface of the panel at the other end of said serially connected panels, said adhesive pattern crossing said three vertical score lines of said sleeve so as to unite the side edges of said cells tightly to the side edges of said sleeve in three of the four corners, and the lateral ends of said sleeve being joined to each other by a manufacturer's joint that is disposed exterior of the sleeve so as to tightly unite said sleeve to said cell in the fourth corner and thereby provide uninterrupted contact between said sleeve inside surface and said cell outside surfaces about the entire perimeter of the bulk container.

2. A bulk container in accordance with claim 1 wherein said sleeve includes flap means hinged to the lateral end of one of said four panels, which flap means is adhesively secured to the outside surface of said panel at the other lateral end.

3. A bulk container in accordance with claim 1 wherein said sleeve has two longitudinal panels which are wider than said other two panels, wherein said flap means are respectively hinged to the remaining two panels of said eight cell panels, which are adhesively secured in surface-to-surface contact to each other and extend across the container as a divider, and wherein said cell manufacturer's joints are located at opposite ends of said divider adjacent the centers of said longitudinal panels.

4. A bulk container in accordance with claim 2 wherein said depending flaps for closing the bottom of the container are interconnected to form a tubular bellows closure and include a first pair hinged to opposed rectangular panels and a second pair hinged to the remaining sleeve panels, said first pair of closure flaps each including a pair of converging score lines oriented at an angle of about 45° to said transverse score line which meet at a location short of the free edge of each flap and including slot means extending from said free edge to a location past said point of meeting.

5. A reusable bulk container for shipping granular products or the like which container includes a pair of rectangular tubular cells each of which is formed from four serially connected panels of corrugated fiberboard having vertical flutes and a flap at one end, a rectangular sleeve surrounding said cells and adhesively joined in surface-to-surface contact to the outer surfaces of six panels of said cells, which sleeve includes four serially connected rectangular side panels and a glue flap defined by vertical score lines, said sleeve panels each carrying depending interconnected flaps for closing the bottom of the container which are defined by a transverse score line and by extensions of said vertical score lines, said interconnected bottom closure flaps including a first pair hinged to opposed lateral side panels of said sleeve and a second pair hinged to the remaining longitudinal side panels, said first pair of closure flaps each including a pair of converging score lines which begin from the intersections of said extensions and said transverse score line and meet at a location short of the free edge of said flap, the depth of said closure flaps being greater than one-half the width of said lateral side panels, and slot means in said first pair of closure flaps, wherein the improvement comprises said remaining two panels of said eight cell panels extending across the container as a divider and being secured in surface-to-surface contact with each other, the flap of each tubular cell being hingedly connected to said divider-forming panel and adhesively attached to the inside surface of the panel at the other end thereof to form a manufacturer's joint for said cell, said manufacturer's joints for said two cells being located at opposite ends of said divider, and said slot means extending from said free edge toward said transverse score line a distance greater than the distance between the intersection of said converging lines and said free edge.

6. A bulk container in accordance with claim 5 wherein each of said cells is formed from a blank having a glue flap at one end which is attached as a manufacturer's joint to the inside surface of the panel at the other end.

7. A bulk container in accordance with claim 5 wherein the width of said slot is at least equal to the thickness of the corrugated board from which said sleeve is formed.

8. A bulk container in accordance with claim 7 wherein said converging score lines are at an angle of about 45° to said transverse score line.

9. A bulk container in accordance with claim 1 wherein said sleeve is formed of corrugated fiber-board having vertical flutes and said sleeve has four side panels plus a glue flap at one end, which glue flap extends downward past said transverse score line, said extension being secured to one of said flaps.

* * * * *